US012290118B2

(12) United States Patent
Ng et al.

(10) Patent No.: US 12,290,118 B2
(45) Date of Patent: May 6, 2025

(54) LIGHTED GAITERS

(71) Applicant: NightHawk Designs and Solutions, LLC, Cumming, GA (US)

(72) Inventors: John Ng, Cumming, GA (US); Jason Laury, Rome, GA (US); Israel Pacheco, Sebastian, FL (US)

(73) Assignee: NightHawk Designs and Solutions, LLC, Cumming, GA (US)

( * ) Notice: Subject to any disclaimer, the term of this patent is extended or adjusted under 35 U.S.C. 154(b) by 0 days.

(21) Appl. No.: 17/670,227

(22) Filed: Feb. 11, 2022

(65) Prior Publication Data

US 2022/0248787 A1 Aug. 11, 2022

Related U.S. Application Data

(60) Provisional application No. 63/148,140, filed on Feb. 11, 2021.

(51) Int. Cl.
*A41D 27/08* (2006.01)
*A41D 17/00* (2006.01)

(52) U.S. Cl.
CPC ..... *A41D 27/085* (2013.01); *A41D 17/00* (2013.01)

(58) Field of Classification Search
CPC ..... A41D 17/00; A41D 27/085; A41D 13/01; A41D 19/0157; A43B 3/36
See application file for complete search history.

(56) References Cited

U.S. PATENT DOCUMENTS 112,436 A * 3/1871 Fessenden ..... A41D 13/01 362/108
271,150 A * 1/1883 Stimpson ..... A41D 17/00 36/51
292,819 A * 2/1884 Howarth, Jr. ..... A41D 17/00 36/2 R
314,840 A * 3/1885 Henning ..... A41D 17/00 24/713.4
1,030,516 A * 6/1912 Lagarde et al. ..... A41D 27/085 362/184
1,070,652 A * 8/1913 Woodward ..... A41D 17/00 2/265

(Continued)

FOREIGN PATENT DOCUMENTS

KR 20-2012-0009017 12/2012

*Primary Examiner* — Heather Mangine
*Assistant Examiner* — Raquel M. Weis
(74) *Attorney, Agent, or Firm* — James A. Sheridan; Sheridan Law, LLC

(57) ABSTRACT

There is disclosed apparel for providing protection and illumination. In an embodiment, a gaiter has a top portion and a bottom portion with a layer of material extending therebetween. The layer of material provides a protective covering to a lower limb of the user. At least one securement mechanism provides an adjustable attachment of the gaiter to the user. The selective mechanism allows attachment of the gaiter with a variety of footwear. A light housing is integrally disposed on an outward portion of the layer of material of the gaiter. The light housing provides illumination adjacent to the foot of a user. The combination of the gaiter and the light housing together provide a body-worn lighting device without attaching the light housing directly to any of the user, the footwear worn by the user, and clothing worn by the user. Other embodiments are disclosed.

18 Claims, 10 Drawing Sheets

(56) References Cited

U.S. PATENT DOCUMENTS 1,274,837 A * 8/1918 Ascheim ..... A41D 17/00 12/142 W
1,539,332 A * 5/1925 Smiley ..... A43B 3/02 36/4
1,680,137 A * 8/1928 Dunbar ..... A41D 17/00 36/2 R
2,176,463 A * 10/1939 Meendsen ..... A41D 17/00 D2/912
2,962,580 A * 11/1960 Jones ..... A41D 27/085 362/108
3,641,333 A * 2/1972 Gendron ..... A41F 9/002 362/108
3,955,063 A * 5/1976 Berger ..... A41D 17/00 219/549
4,406,040 A * 9/1983 Cannone ..... F21V 21/0885 24/3.12
4,535,392 A * 8/1985 Montgomery ..... G08B 5/38 362/186
4,599,682 A * 7/1986 Stephens ..... G08B 5/006 362/225
4,896,437 A * 1/1990 Johnson ..... A41D 17/00 2/22
5,031,247 A * 7/1991 Carter ..... A41D 17/00 2/919
5,113,325 A * 5/1992 Eisenbraun ..... G09F 21/02 362/800
5,183,324 A * 2/1993 Thomas ..... F21V 21/0885 362/108
5,245,516 A * 9/1993 de Haas ..... G08B 5/004 362/108
5,249,106 A * 9/1993 Barnes ..... A41D 13/01 362/108
5,353,441 A * 10/1994 Lazorchak ..... A41F 11/04 2/303
5,469,342 A * 11/1995 Chien ..... A42B 1/242 224/660
5,469,637 A * 11/1995 Adam ..... A43B 5/145 36/2 B
5,588,919 A * 12/1996 Nakamura ..... A63B 69/3608 473/212
5,613,756 A * 3/1997 Allen ..... A41D 27/085 362/189
5,649,755 A * 7/1997 Rapisarda ..... A43B 3/36 362/108
5,667,294 A * 9/1997 Lo ..... A42B 3/044 362/249.05
5,688,038 A * 11/1997 Chien ..... B60Q 1/2673 362/812
5,716,120 A * 2/1998 Hung ..... A41D 13/08 362/253
5,779,348 A * 7/1998 Interlicchio ..... A41D 13/01 362/108
5,815,948 A * 10/1998 Dzielak ..... A41D 17/00 2/22
5,871,269 A * 2/1999 Chien ..... B60Q 1/2673 362/474
6,007,211 A * 12/1999 Cheung ..... G09F 13/00 362/311.03
6,013,346 A * 1/2000 Lewis ..... G09F 9/33 428/42.1
6,062,700 A * 5/2000 Price ..... A45F 5/00 362/205
6,174,075 B1 * 1/2001 Fuwausa ..... F21L 2/00 362/310
6,185,752 B1 * 2/2001 Hendersen ..... A41D 17/00 2/242
6,279,170 B1 * 8/2001 Chu ..... G09F 3/208 2/246
6,301,803 B1 * 10/2001 Patterson ..... A41D 17/00 36/1.5
6,457,260 B1 * 10/2002 Roelofs ..... A41D 17/00 2/23
6,618,862 B1 * 9/2003 Bunjes ..... A41D 27/145 2/232
7,069,670 B1 * 7/2006 Gerke ..... A41D 17/00 2/22
7,267,452 B2 * 9/2007 Esses ..... A41D 27/085 362/276
7,549,763 B2 * 6/2009 Kim ..... A42B 3/044 362/396
7,574,753 B1 * 8/2009 Seyfried ..... A41D 27/085 2/311
7,748,058 B2 * 7/2010 Steitle ..... A41D 27/08 2/232
8,161,570 B2 * 4/2012 McVeigh ..... A63B 69/0002 2/24
8,616,719 B1 * 12/2013 Barze ..... A41D 13/01 362/108
8,752,974 B2 * 6/2014 Leibowitz ..... A63B 71/0686 362/109
9,013,100 B2 * 4/2015 Bushee ..... A01K 85/01 313/512
10,485,288 B2 * 11/2019 Pacheco ..... A43B 3/02
10,681,956 B1 * 6/2020 Anderson ..... A43B 3/18
11,058,189 B2 * 7/2021 Steiner ..... A44C 5/00
11,089,825 B1 * 8/2021 Ell ..... A41D 1/002
2001/0024364 A1 * 9/2001 Hurwitz ..... H05B 33/00 362/293
2001/0042262 A1 * 11/2001 Chu ..... G09G 3/3611 2/246
2002/0109981 A1 * 8/2002 Amici ..... A43B 1/0036 36/137
2004/0015117 A1 * 1/2004 Gauthier ..... A63B 71/1225 602/62
2004/0047146 A1 * 3/2004 Galoob ..... A41D 13/01 362/812
2004/0100792 A1 * 5/2004 Trzecieski ..... A63C 3/00 36/137
2007/0000028 A1 * 1/2007 Esses ..... A41B 11/001 2/239
2008/0019120 A1 * 1/2008 Rapisarda ..... H05K 3/325 362/103
2008/0117624 A1 * 5/2008 Kirkov ..... A43B 3/36 362/108
2010/0039802 A1 * 2/2010 Tuan ..... F21V 33/0008 362/185
2010/0138971 A1 * 6/2010 McVeigh ..... A63B 69/0002 2/22
2010/0220046 A1 * 9/2010 Plotz ..... G02F 1/133603 362/249.02
2011/0277204 A1 * 11/2011 Chan ..... A41D 13/01 2/22
2011/0292642 A1 * 12/2011 Tseng ..... A41D 27/085 362/396
2012/0078393 A1 * 3/2012 Kotb ..... H05B 47/19 700/90
2012/0099298 A1 * 4/2012 Hsu ..... A41D 27/085 362/103
2012/0155065 A1 * 6/2012 Ubaghs ..... F21V 33/0008 362/103
2012/0285047 A1 * 11/2012 Pacheco ..... A43B 3/02 36/137
2013/0077289 A1 * 3/2013 Gridley ..... F21V 33/0008 362/103
2013/0107499 A1 * 5/2013 Noble ..... A41D 13/065 362/103
2014/0041260 A1 * 2/2014 Jewell ..... A43B 1/0072 36/2 R
2015/0016093 A1 * 1/2015 Wilson ..... A41D 19/0024 362/103
2015/0250236 A1 * 9/2015 Garcia ..... A41D 13/0543 2/22
2017/0363279 A1 * 12/2017 Macias ..... F21L 4/00
2018/0116313 A1 * 5/2018 James ..... A41D 27/208
2018/0149346 A1 * 5/2018 Rapisarda ..... A43B 3/36
2018/0295904 A1 * 10/2018 Looper ..... A41D 13/01
2019/0021411 A1 * 1/2019 Chen ..... A41D 27/085
2019/0066475 A1 * 2/2019 Bordelon ..... A01M 29/24

(56) References Cited

U.S. PATENT DOCUMENTS

| | | | | |
|---|---|---|---|---|
| 2019/0098941 | A1* | 4/2019 | Lynch | F21V 33/0008 |
| 2020/0018474 | A1* | 1/2020 | Sturman | F21V 23/001 |
| 2020/0037681 | A1* | 2/2020 | Mathers | A41D 31/065 |
| 2020/0093208 | A1* | 3/2020 | Dana | A41D 31/065 |
| 2022/0248787 | A1* | 8/2022 | Ng | A41D 27/085 |

* cited by examiner

LIGHTED GAITERS

REFERENCE TO PENDING PRIOR PATENT APPLICATION

This application claims the benefit under 35 U.S.C. 119(e) of U.S. Provisional Patent Application No. 63/148,140, filed Feb. 11, 2021, by John Ng, et al., for "LIGHTED GAITERS," which patent application is hereby incorporated herein by reference.

BACKGROUND

Generally, traditional gaiters only function to insulate the lower limb. Being easily removable and usable with a wide variety of clothing and footwear, gaiters may provide supplement warmth and protection from weather and other outdoor hazards when desired.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an embodiment, there is provided apparel for providing protection and illumination adjacent to a foot of a user. The apparel may include a gaiter having a top portion and a bottom portion in opposition to one other, a layer of material extending between the top portion and the bottom portion, the layer of material extending a given distance to provide a protective covering to a lower limb of the user, and at least one securement mechanism to provide an adjustable attachment of the gaiter to the lower limb of the user. The selective mechanism may allow attachment of the gaiter to the lower limb of the user with a variety of footwear. A light housing may be integrally disposed on an outward portion of the layer of material of the gaiter. The light housing may be configured to provide illumination adjacent to the foot of a user. The combination of the gaiter and the light housing together may provide a body-worn lighting device positionable between the foot and the knee of the user without attaching the light housing directly to any of the user, the footwear worn by the user, and clothing worn by the user.

In another embodiment, there is provided a gaiter having a top portion and a bottom portion in opposition to one other, a layer of material extending between the top portion and the bottom portion, the layer of material extending a given distance to cover a knee, a shin, a calf, an ankle, and a part of the footwear of the user. A light housing may be integrally disposed on an outward portion of the layer of material of the gaiter.

Other embodiments are also disclosed.

Additional objects, advantages and novel features of the technology will be set forth in part in the description which follows, and in part will become more apparent to those skilled in the art upon examination of the following, or may be learned from practice of the technology.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

DETAILED DESCRIPTION

Embodiments are described more fully below in sufficient detail to enable those skilled in the art to practice the system and method. However, embodiments may be implemented in many different forms and should not be construed as being limited to the embodiments set forth herein. The following detailed description is, therefore, not to be taken in a limiting sense.

In various embodiments, there are provided lighted gaiters that illuminate obstacles for the user or aid visibility of the user to others, or a combination of the two. Furthermore, the lighted gaiters provide insulation and protection for the lower limb.

Lighted gaiters may generally be useful to outdoor enthusiasts such as hunters, hikers, and fishermen. Lighted gaiters may also be used by workers in low light work environments and conditions.

Figure 1:
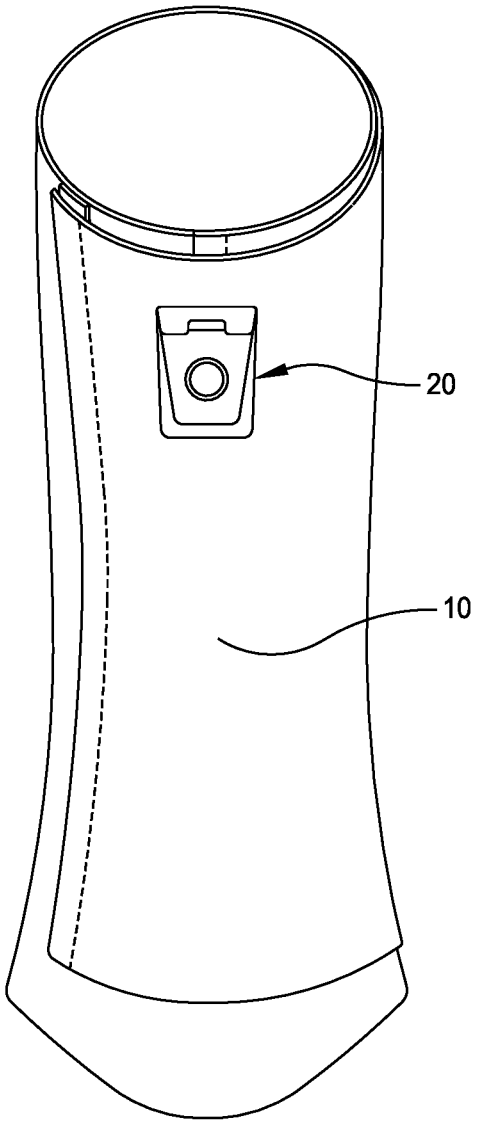
FIG. 1 illustrates a front perspective view of one lighted gaiter with a light housing positioned in the front upper portion.
Figure 2:
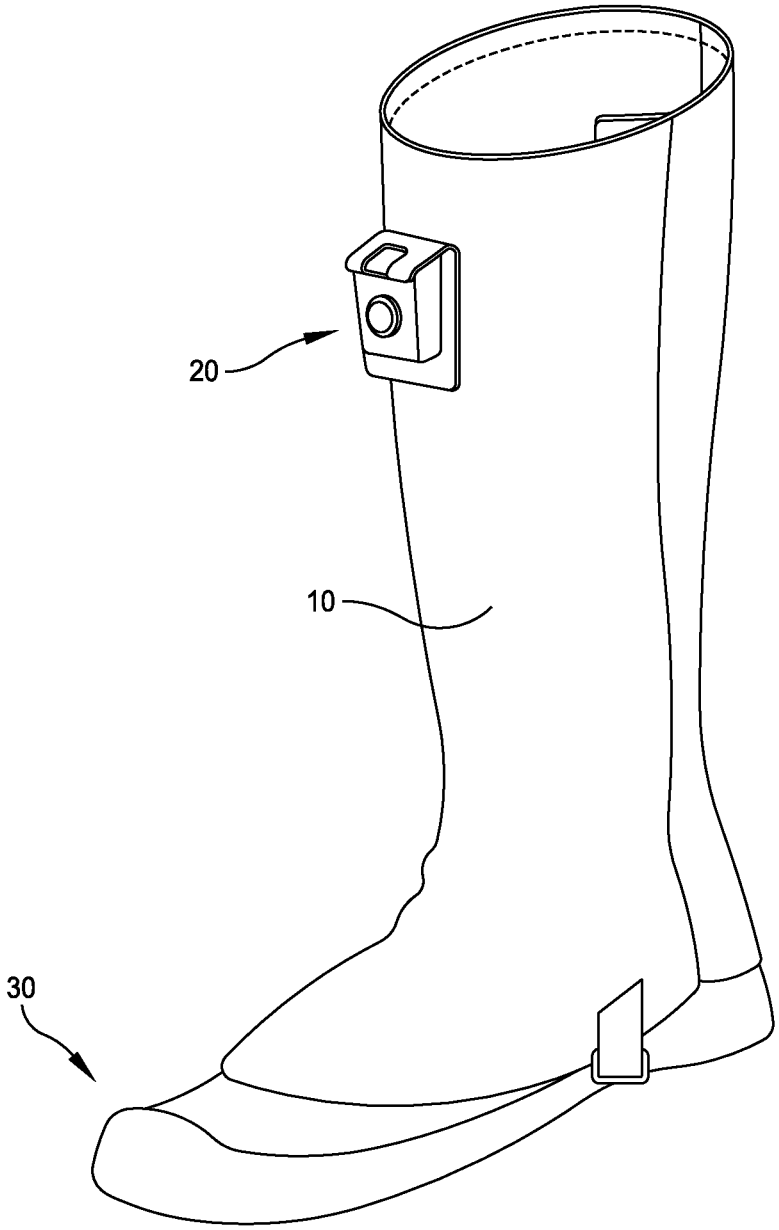
FIG. 2 illustrates a perspective view of the one lighted gaiter of FIG. 1 with the light housing positioned in the upper front portion.

With reference to FIGS. 1 and 2, and in an embodiment, there is shown one lighted gaiter 10 with a light housing 10. The light housing 10 may be positioned in the front upper portion of gaiter 10. Gaiter 10 is shown disposed on a shoe 30 in FIG. 2.

Unlike traditional gaiters, lighted gaiters 10 not only provide an added physical layer that provides insulation for the lower limb against different climate conditions such as rain, snow, wind, and sun, but each of gaiters 10 also provides lighting for the user or wearer. This may aid the wearer in visualizing obstacles and objects in low light conditions or in complete darkness while allowing the wearer's hands to be free of carrying any illuminating devices such as a flashlight. The lighting from the lighted gaiters 10 provides more superior ground level illumination without the need for crouching in order to create more desired ground level lighting from other illuminating devices, such as, for example, a headlamp. As compared to using a headlamp, lighted gaiters 10 may likewise provide hands free illuminations; nonetheless, lighted gaiters provide a light source that is away from the wearer's nose and mouth, which helps prevent impaired illumination from exhalation fogging in frigid weather conditions.

Figure 3:
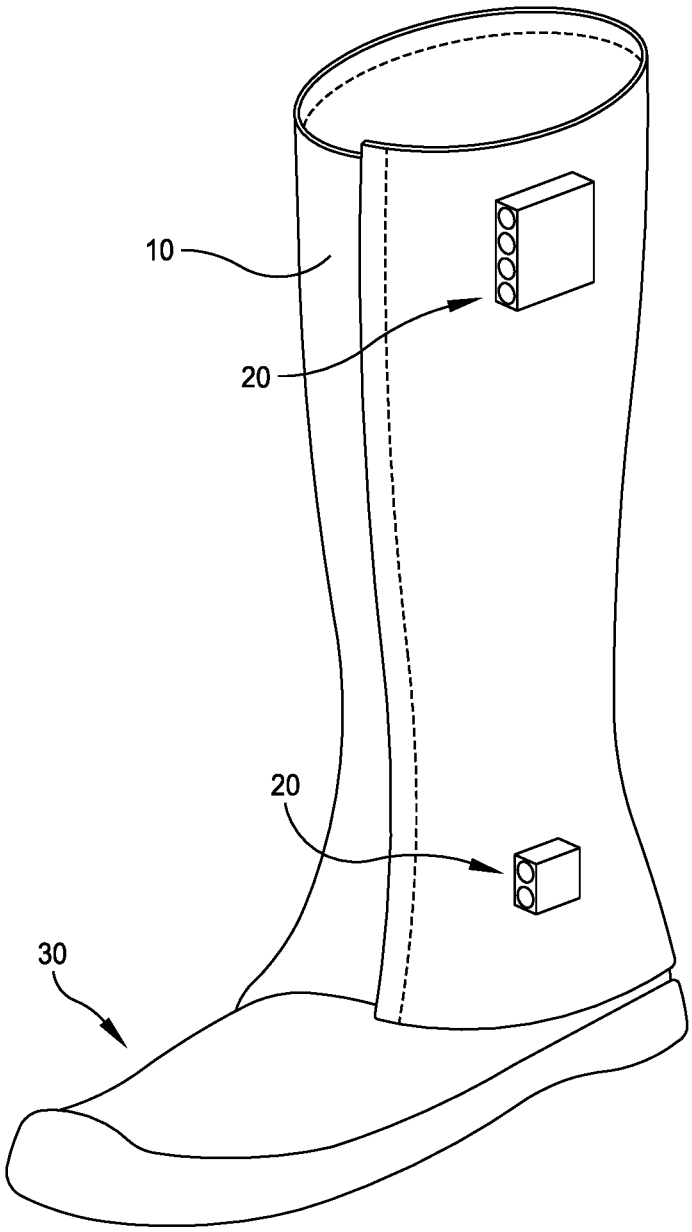
FIG. 3 illustrates a perspective view of one lighted gaiter with a light housing positioned in the upper lateral portion and one light housing positioned in the lower lateral portion.

Now referring to FIG. 3, and in one embodiment, there is shown one lighted gaiter 10 with light housing 20 positioned in an upper lateral portion and another light housing 10 positioned in the lower lateral portion. Furthermore, gaiter 10 is disposed on footwear 30 (which may be referred to as a boot 30 or a shoe 30). Furthermore, it should be appreciated that unlike a specialized shoe or pant-leg carrying a light device, Lighted gaiter 10 may be worn over any footwear or boot. Furthermore, lighted gaiter 10 may be donned or doffed very quickly. Being coupled together with one another, lighted gaiter 10 quickly positions light housing 20 with preselected adjustment of securement features. Additionally, light housing 20 is protected and less likely to get misplaced as being an integral portion of lighted gaiter 10.

Figure 4:
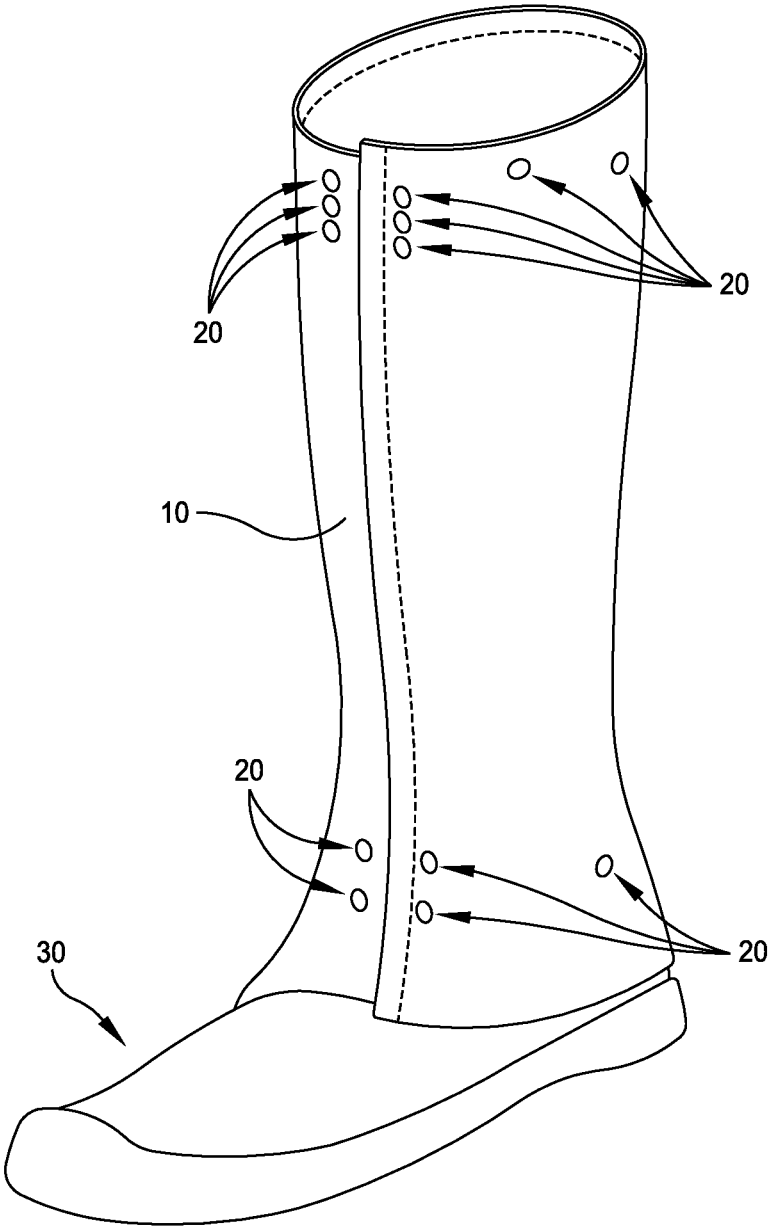
FIG. 4 illustrates a perspective view of one lighted gaiter with multiple lights embedded in the upper front, lower front, upper lateral, and lower lateral portions of the gaiter.

With reference now to FIG. 4, and in another embodiment, there is shown one lighted gaiter 10 with multiple lights 20 embedded in upper front, lower front, upper lateral, and lower lateral portions of gaiter 10. Boot 30 is shown beneath gaiter 10.

Figure 5:
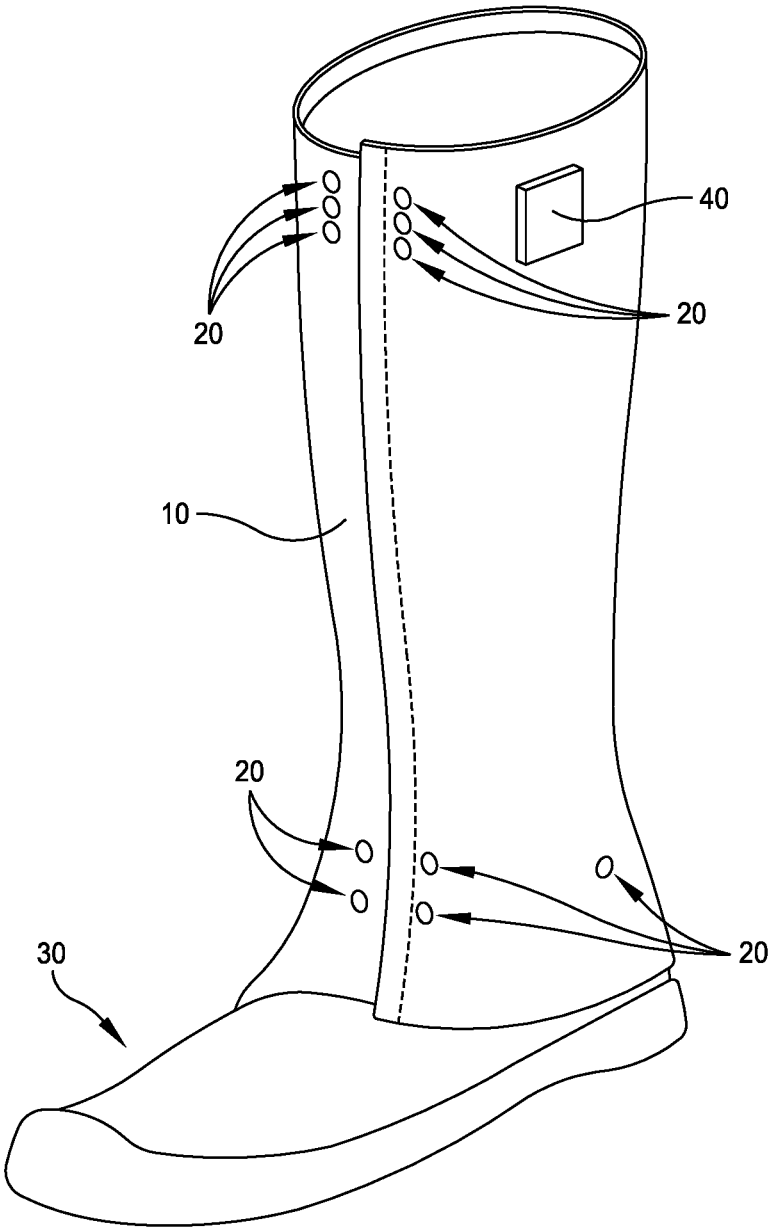
FIG. 5 illustrates a perspective view of one lighted gaiter with multiple lights embedded in the upper front, lower front, and lower lateral portions of the gaiter and a battery compartment located in the upper lateral portion of the gaiter.

With reference now to FIG. 5, and in an embodiment, there is shown one lighted gaiter 10 with multiple lights embedded in upper front, lower front, and lower lateral portions of gaiter 10. A battery compartment 40 may be located in the upper lateral portion of gaiter 10. Boot 30 is shown beneath gaiter 10.

Figure 6:
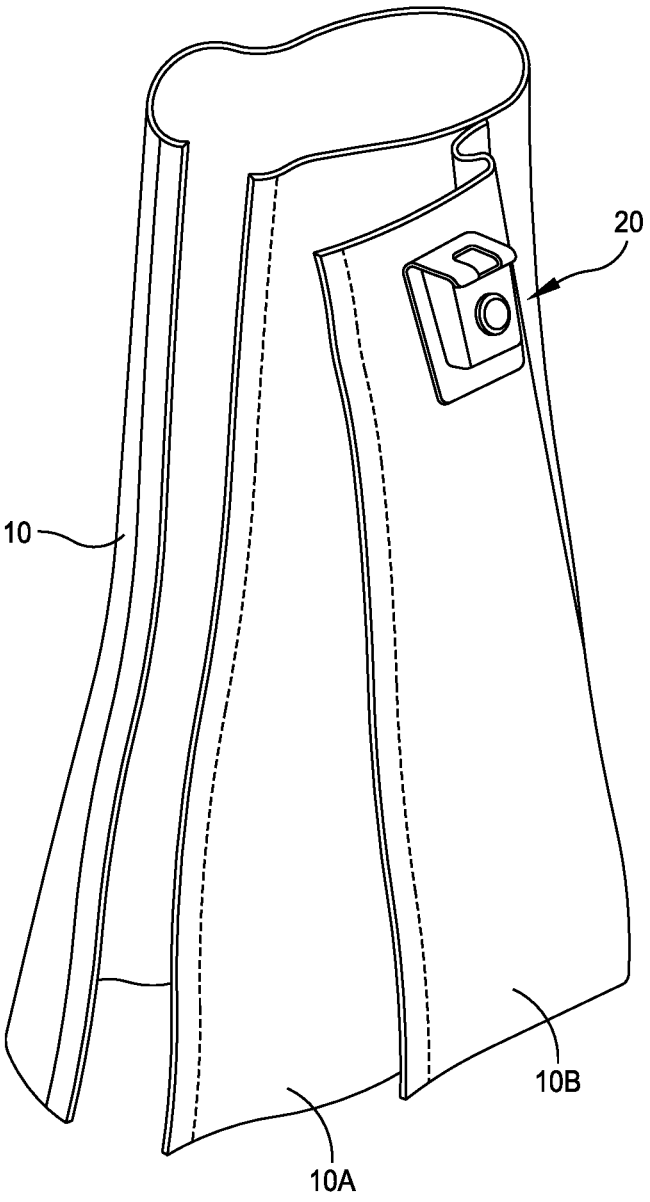
FIG. 6 illustrates a perspective view of one multiple layered lighted gaiter with a light housing positioned in the upper front portion of the outer layer of the gaiter.

With reference now to FIG. 6, and in one embodiment, there is shown one multiple layered lighted gaiter 10 (with an inner layer 10A and an outer layer 10B). Light housing 20 may be positioned in an upper front portion of the outer layer 10B of gaiter 10.

Figure 7:
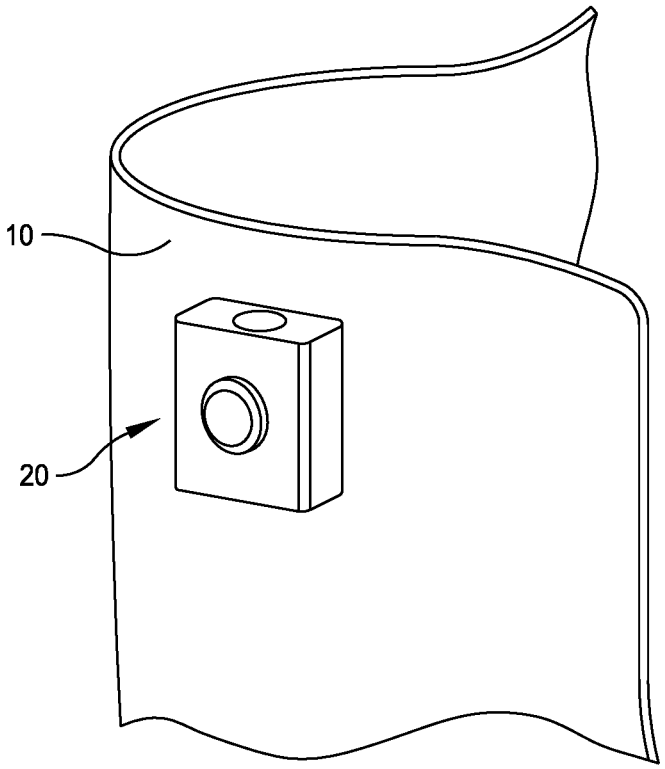
FIG. 7 illustrates a perspective view of a light housing molded directly onto the surface of the upper front portion of the gaiter.

Looking at FIG. 7, and in an embodiment, there is shown light housing 20 molded directly onto the surface of the upper front portion of gaiter 10. In this configuration, light housing 20 is a permanent, integral portion of gaiter 10.

Figure 8:
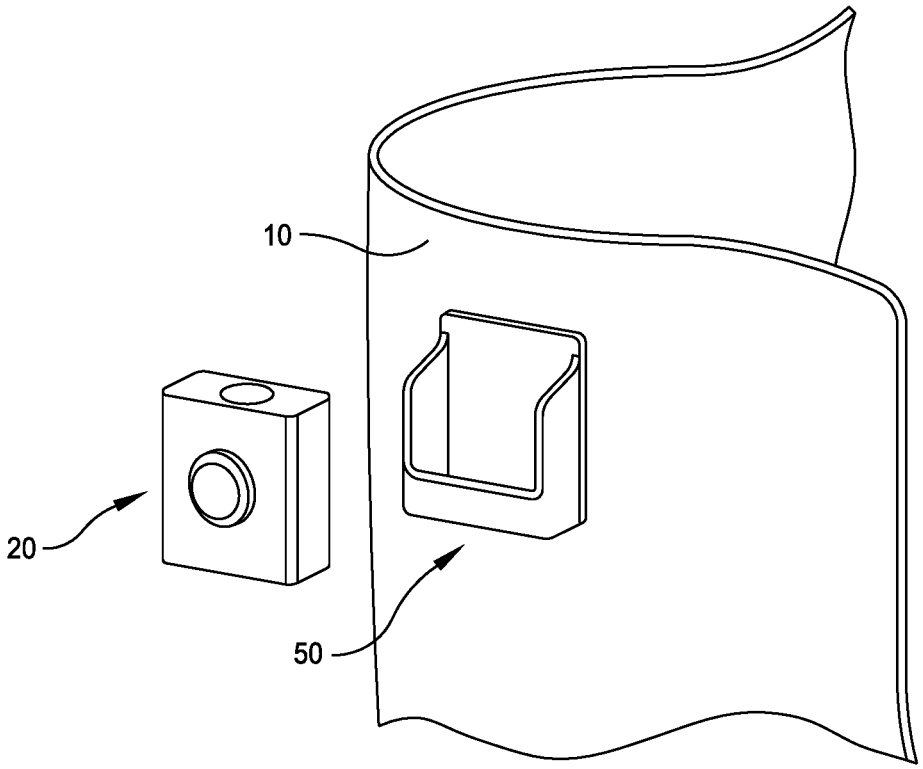
FIG. 8 illustrates a perspective view of a holster molded directly onto the surface of the upper front portion of the gaiter and a light housing that can be attached thereto.

Looking now at FIG. 8, an in another embodiment, there is shown a holster 50 molded directly onto the surface of an upper front portion of gaiter 10. Light housing 20 may be selectively attached to the holster 50. In this configuration, light housing 20 is removable from gaiter, and light housing 20 together with holster 50 forms an integral portion of gaiter 10.

Figure 9:
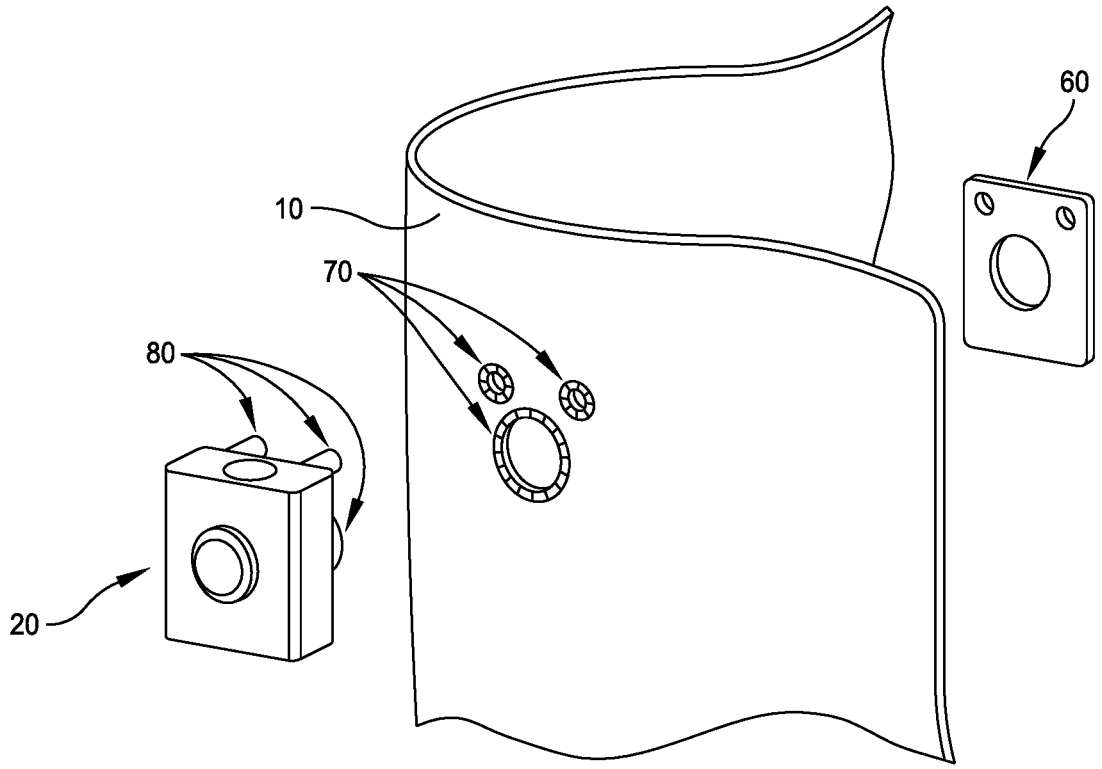
FIG. 9 illustrates a perspective view of a light housing, a backing plate, and openings in the upper front portion of a gaiter.

With reference now to FIG. 9, and in an embodiment, light housing 20 may be removably attached to gaiter 10. A backing plate 60 may be configured within an interior surface of gaiter 20. Openings 70 may be formed though gaiter 10. Extensions 80 from light housing 20 may be configured to extend through openings 70 and selectively attach with backing plate 60 to position light housing 20 on the outer surface of gaiter 10. Light housing 20 using backing plate 60 forms a removable and integral portion of gaiter 10.

Figure 10:
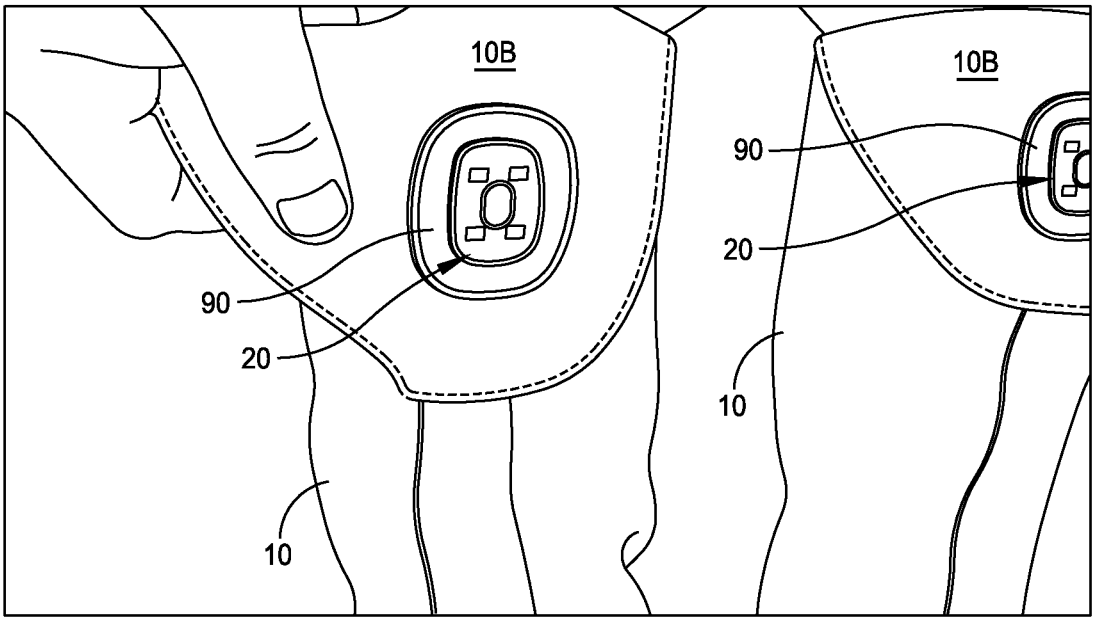
FIGS. 10 and 11 illustrate a perspective view of a pair of gaiters with a crown sized to retain a light housing therein.
Figure 11:
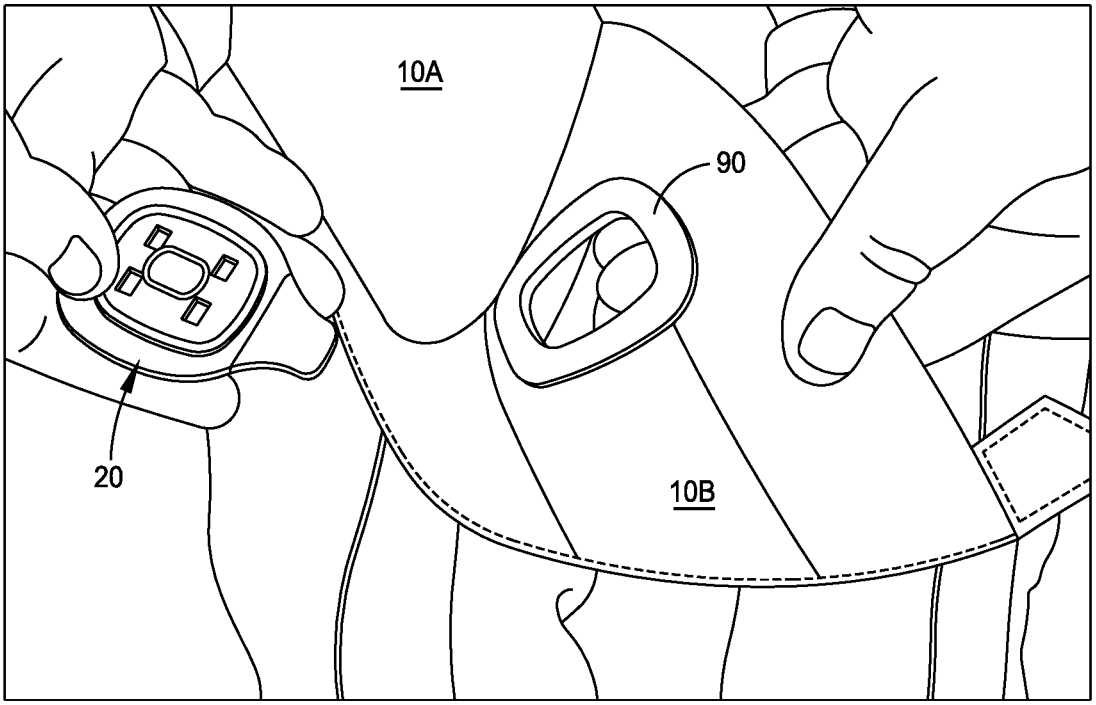

With reference now to FIGS. 10 and 11, and in an embodiment, there is shown a pair of multiple layered lighted gaiters 10 (with an inner layer 10A and an outer layer 10B). Light housing 20 may be positioned in an upper front portion of the outer layer 10B of gaiter 10. Outer layer 10B may include a crown 90 formed by a circular rubber insert sewn onto sleeve of the leg gaiter. Crown 90 may be configured to retain light housing 20 in place with a compression fit. The sleeve may provide a fabric layer sewn on the top upper portion of the leg gaiter that holds crown 90. The shape of the sleeve may be provided in various forms. The crown can also be in different shapes and made with different materials other than rubber and plastic. The light housing (as discussed herein) can be made in different shapes, sizes, and dimensions.

Lighted gaiters not only offer protection to the lower limb but may also provide lighting that allows the wearer to see and identify obstacles on and off the ground, in low light conditions and in complete darkness, while allowing the wearer hands to be free from carrying any illuminating devices such as a flashlight.

The light on the lighted gaiters also is superior to traditional gaiters by aiding visibility of the wearer to others who are around the wearer, such visibility provides safety to the wearer and aids in accident prevention in the dark.

The lighting also provides more superior ground level illumination as compared to using a flashlight or a headlamp as superior ground level illumination eliminates the need for crouching the user's body to redirect light source in order to achieve increased ground level visibility. As compared to using a headlamp, lighted gaiters provide light source away from the wearer's nose and mouth, which helps prevent impaired illumination from exhalation fogging in frigid weather conditions.

One or more lighted gaiter may be superior to the use of flashlights as the lighted gaiters provide illumination for the wearer while freeing the one's hands for other tasks.

In general, various embodiments of lighted gaiters create a layer of insulation to the lower limb while providing lighting that allows the wearer to see and identify obstacles on and off the ground in low light conditions and in complete darkness. The light on the gaiters can also aid visibility of the wearer to others who are around the wearer Such visibility provides safety to the wearer and aids in accident prevention in the dark. A wearer can achieve hands free illumination, superior ground level lighting, and obstruction free lighting from exhalation fogging as discussed.

The lighted gaiters are designed to add one or more layers to the lower limb that cover the knee, shin, calf, ankle, and part of the foot. The texture of the lighted gaiters may be either soft or hard, or a combination of the two, with prior texture form that offers flexibility and durability and latter texture form that can withstand external blunt forces such as one from a snake bite without permitting perforation.

The physical layer added by the gaiters also provide insulation for the wearer against different climate conditions such as rain, snow, wind, and sun. Various materials may be used in or added to the composition of the gaiters and give rise to various textile properties such as semi-permeability that allows the flow of air and moisture through the material and water resistance or waterproof properties.

The gaiter may be wrapped around the lower limb and secured by mechanism of buttons, Velcro, hooks, zipper, clasps, or by a combination of the mechanisms. The gaiters may contain one or more elastic bands within the layer of the gaiter that serves to secure the gaiter around the top and bottom portions of the lower limb. The gaiter may include a crown formed by a circular rubber insert sewn onto a sleeve of the leg gaiter. This crown may be configured to retain the light housing in place with a compression fit. The sleeve may provide a fabric layer sewn on the top upper portion of the leg gaiter that holds the crown. The shape of the sleeve may be provided in various forms. The crown can also be in different shapes and made with different materials other than rubber and plastic. The light housing (as discussed herein) can be made in different shapes, sizes, and dimensions.

The gaiter may include a strap that secures the gaiter around the bottom of the shoe by mechanism of buttons, Velcro, hooks, zipper, clasps, or by a combination of the mechanisms on the strap.

The lighted gaiters provide illumination for the wearer using one or more light emitting diodes (LEDs) disposed in a water resistant or waterproof light housing. The light emitting diodes (LEDs) may be positioned on the surface of or embedded within the layer of the gaiter operatively connected to a waterproof battery container. The LEDs may be positioned in the top, middle, or lower portion in the front, lateral, or back side of the gaiter, or in combination of the portions and sides.

The LEDs may be disposed to shine forward and downward ahead of the toe of the footwear or to shine downward on the lateral or back side of the lower limb, or from a combination of the positions. The side LEDs may emit light of one or more frequencies, colors, or intensities. The frequencies, colors, and intensities of the LEDs may be controlled by an electronic circuit board or a printed circuit board operatively coupled to the LEDs. The waterproof light housing and the waterproof battery container comprise a battery compartment with one or more batteries therein operatively coupled to the light to power the light and a switch operatively coupled to the battery and the light to control operation of the electronic circuit board or printed circuit board and the light.

In various embodiments, the waterproof light housing may be directly molded to the surface of the gaiter. The waterproof light housing may be attached to a designated holster that is directly molded to the surface of the gaiter. The waterproof light housing may be secured to the surface of the gaiter by coupling a backing plate with the posterior or lateral side of the light housing through purposeful openings in the gaiter.

Although the above embodiments have been described in language that is specific to certain structures, elements, compositions, and methodological steps, it is to be understood that the technology defined in the appended claims is not necessarily limited to the specific structures, elements, compositions and/or steps described. Rather, the specific aspects and steps are described as forms of implementing the claimed technology. Since many embodiments of the technology can be practiced without departing from the spirit and scope of the invention, the invention resides in the claims hereinafter appended.

What is claimed is:

1. Apparel for providing protection and illumination adjacent to a foot of a user, the apparel comprising:

a gaiter having a top portion and a bottom portion in opposition to one another, a layer of material extending between the top portion and the bottom portion, the layer of material extending a given distance configured to provide a protective covering to a lower limb of the user, a flap formed by an outer fabric layer disposed on an outermost surface of the layer of material, and at least one securement fastener to provide an adjustable attachment of the gaiter to the lower limb of the user, wherein the at least one securement fastener is configured to allow attachment of the gaiter to the lower limb of the user with a variety of footwear;

a light housing positioned in the flap in direct contact against each of the layer of material and the outer fabric layer, the light housing positioned to extend through the outer fabric layer of material of the gaiter, the light housing includes at least one light emitting diode (LED), and the at least one light emitting diode (LED) having a configuration to shine forward and downward ahead of a toe of the footwear worn by a user, and the light housing configured to provide illumination adjacent to a foot of a user; and the combination of the gaiter and the light housing together providing a body-worn lighting device positionable between the foot and a knee of the user without attaching the light housing directly to any portion of the user, the footwear worn by the user, and clothing worn by the user.

2. Apparel in accordance with claim 1, wherein the gaiter is configured to cover the knee, a shin, a calf, an ankle, and a part of the footwear of the user.

3. Apparel in accordance with claim 1, wherein the gaiter is configured to cover a part of a shin, a part of a calf, an ankle, and a part of the footwear of the user.

4. Apparel in accordance with claim 1, wherein the protective covering of the layer of material is configured to shield the knee, a shin, a calf, an ankle, and a part of the footwear of the user from external forces.

5. Apparel in accordance with claim 1, wherein the protective covering of the layer of material is configured to shield a part of a shin, a part of a calf, an ankle, and a part of the footwear of the user from external forces.

6. Apparel in accordance with claim 1, wherein the protective covering of the layer of material is configured to provide insulation from climate conditions to a part of a shin, a part of a calf, an ankle, and a part of the footwear of the user from external forces.

7. Apparel in accordance with claim 1, wherein the at least one securement fastener further includes at least one of buttons, hook-and-loop fasteners, hooks, a zipper, and clasps.

8. Apparel in accordance with claim 1, wherein the at least one securement fastener includes one or more elastic bands located within the layer of material of the gaiter so as to selectively secure the top portion and the bottom portion of the gaiter around the lower limb.

9. Apparel in accordance with claim 1, wherein the light housing is operatively connected to a waterproof battery container carried by the gaiter.

10. Apparel in accordance with claim 1, wherein the light housing is disposed in a waterproof light housing integrally molded on the outward portion of the layer of material of the gaiter.

11. Apparel in accordance with claim 1, further comprising a crown formed by a circular rubber insert sewn onto the layer of material of the gaiter, and wherein the light housing is integrally retained by the crown into the layer of material of the gaiter.

12. Apparel in accordance with claim 1, wherein the light housing is positioned adjacent to the top portion of the gaiter.

13. Apparel in accordance with claim 12, wherein the light housing is positioned in a front portion of the gaiter.

14. Apparel in accordance with claim 1, wherein the gaiter includes a crown formed by a circular rubber insert sewn on a sleeve of the gaiter, and the crown is configured to retain the light housing in place with a compression fit.

15. Apparel in accordance with claim 1, wherein the protective container sleeve defines an opening for insertion and removal of the light housing.

16. A gaiter comprising: a top portion and a bottom portion in opposition to one another, a layer of material extending between the top portion and the bottom portion, the layer of material extending a given distance (1) configured to cover a knee, a shin, a calf, and an ankle, the layer of material extending the given distance (2) further configured to cover a part of footwear of a user, a flap formed by an outer fabric layer disposed on an outermost surface of the layer of material, and a light housing positioned in the flap in direct contact against each of the layer of material and the outer fabric layer, the light housing positioned to extend through the outer fabric layer of the gaiter, the light housing includes at least one light emitting diode (LED), and the at least one light emitting diode (LED) having a configuration to shine forward and downward ahead of a toe of the footwear worn by the user, and the light housing configured to provide illumination adjacent to a foot of the user.

17. The gaiter of claim 16, wherein the layer of material is configured to be positionable between the foot and the knee of the user without attaching the light housing directly to any portion of the user, the footwear worn by the user, and clothing worn by the user.

18. The gaiter of claim 16, wherein the protective container sleeve defines an opening for insertion and removal of the light housing.

* * * * *